United States Patent [19]

Reynolds

[11] Patent Number: 5,067,387

[45] Date of Patent: Nov. 26, 1991

[54] RAIL GUNS

[75] Inventor: Graham A. Reynolds, Coventry, England

[73] Assignee: Rolls-Royce plc, England

[21] Appl. No.: 573,996

[22] Filed: Aug. 28, 1990

[30] Foreign Application Priority Data

Oct. 13, 1989 [GB] United Kingdom ..... 8923126

[51] Int. Cl.[5] ..... F41B 6/00

[52] U.S. Cl. ..... 89/8; 124/3

[58] Field of Search ..... 42/76.01; 89/8, 14.05, 89/14.1; 124/3

[56] References Cited

U.S. PATENT DOCUMENTS

| | | | |
|---|---|---|---|
| 1,450,558 | 4/1923 | Maze | 89/14.05 |
| 4,176,487 | 12/1979 | Manis | 42/76.01 |
| 4,796,511 | 1/1989 | Eyssa | 89/8 |

*Primary Examiner*—Stephen C. Bentley

*Attorney, Agent, or Firm*—Oliff & Berridge

[57] ABSTRACT

A rail gun (10) comprising two elongate co-extensive rail electrodes (11,12) having confronting surfaces (17,18) which are of toothed cross-section configuration. The toothed configuration of the surfaces ensures that during the operation of the rail gun (10), there is not an electric current concentration in the vicinity of the confronting surfaces (17,18). Consequently problems associated with the overheating of the confronting surfaces (17,18) are reduced.

7 Claims, 2 Drawing Sheets

RAIL GUNS

This invention relates to rail guns and in particular to the electrodes of rail guns.

A rail gun conventionally comprises two parallel rail electrodes between which is placed an electrically conductive projectile or an armature arranged to propel a projectile. When a very large electric current is passed between the electrodes via the electrically conductive projectile or armature, intense electric and magnetic fields are established. This results in the acceleration of the electrically conductive projectile or armature along the gap between the rail electrodes by the force resulting from the interaction between the magnetic field between the rail electrodes and the moving charge particles in the electrically conductive projectile or armature.

Rail guns, or charged particle accelerators as they are sometimes known, can be used as effective weapon systems. If an electric current of sufficient magnitude is passed through the rail electrodes and the electrically conductive projectile or armature, very high levels of projectile acceleration can be achieved. However it has been found that if such large electric currents are utilised, undesirable overheating of the rail electrodes can occur placing a serious limitation on their life. This overheating has been found to be caused by a tendency for the electric current through the rail electrodes to concentrate adjacent the rail electrode surfaces which confront the projectile or armature.

It is an object of the present invention to provide a rail gun having rail electrodes in which there is a decreased tendency for the electric current operationally passing through the rail electrodes to so concentrate.

According to the present invention, a rail gun comprises two elongate co-extensive spaced apart rail electrodes for carrying an electric current, said electrodes being operationally of opposite polarity, each of said electrodes having a surface of toothed cross-section configuration along the majority of its length, each of said teeth extending transversely to the longitudinal extent of its respective rail electrode, each tooth on one of said electrodes having a face which confronts a corresponding face on a tooth of the other rail electrode so that said confronting tooth faces are parallel, each of said confronting tooth faces being coplanar with the confronting faces of the remaining teeth on its respective rail electrode.

The invention will now be described, by way of example, with reference to the accompanying drawings in which.

Figure 1:
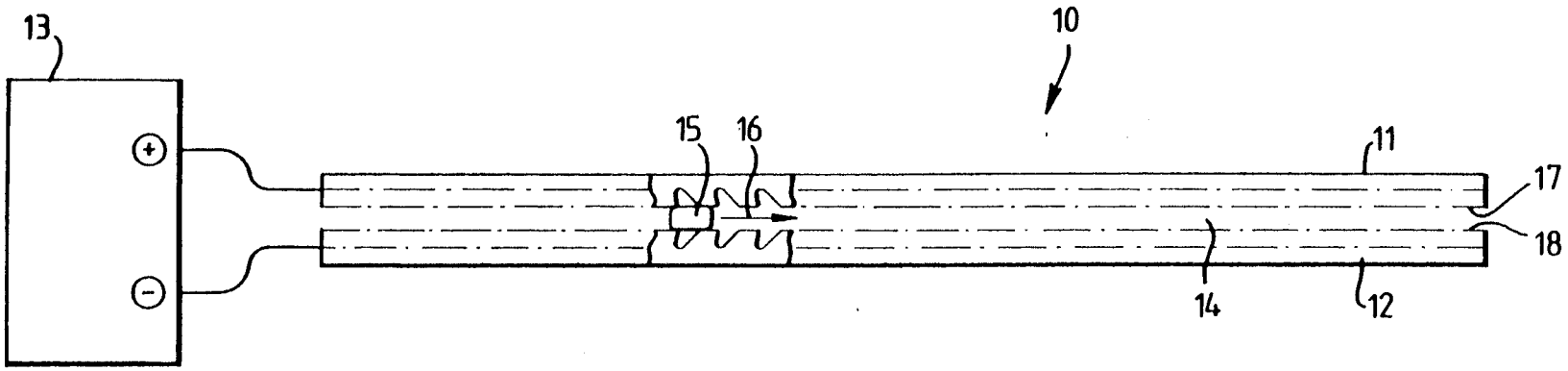
FIG. 1 is a diagrammatic view of the essential features of a rail gun in accordance with the present invention.

With reference to FIG. 1, a rail gun 10 comprises two elongate co-extensive rail electrodes 11 and 12 which are connected to a source of very large DC electrical output 13 so as to be of opposite polarity. A suitable source could, for instance, be a homopolar generator.

The rail electrodes 11 and 12 are spaced apart to define a gap 14 for the reception of an electrically conductive projectile 15. The projectile 15 is in electrical contact with the rail electrodes 11 and 12 so that during the operation of the source of very high electrical output 13, current flows from one rail electrode 11 to the other rail electrode 12 via the projectile 15. Intense electric and magnetic fields resulting from this current flow cause rapid acceleration of the projectile 15 in the direction indicated by the arrow 16 until it is ejected at very high velocity from the rail gun 10.

It will be appreciated that although only the rail electrodes 11 and 12 of the rail gun 10 are depicted in FIG. 1, other constraining means in the form of a gun barrel (not shown) in which the rail electrodes 11 and 12 are located are present to ensure that the projectile 15 follows the correct path between the rail electrodes 11 and 12. Moreover although the projectile 15 is depicted as a single item, it may in certain cases be desirable to propel the projectile using an electrically conductive armature. This of course permits the use of a projectile which is electrically non-conductive.

Figure 2:
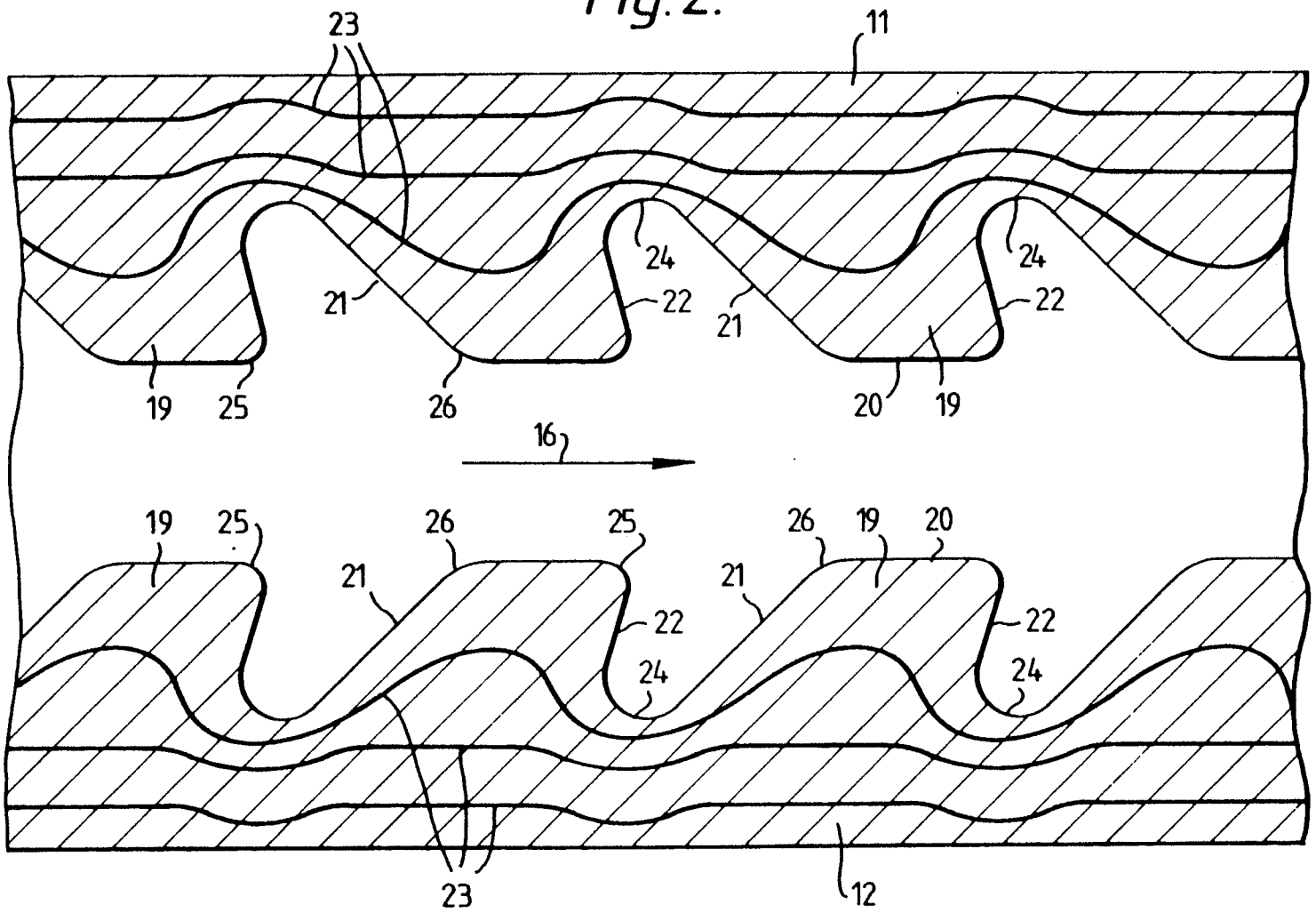
FIG. 2 is a sectioned side view on an enlarged scale of a portion of the rail electrodes of the rail gun shown in FIG. 1.

The confronting surfaces 17 and 18 of the rail electrodes 11 and 12 respectively are of similar regular toothed cross-section configuration as can be seen more clearly if reference is now made to FIG. 2. Each tooth 19 extends transversely to the longitudinal extent of its respective rail electrode 11,12 and is provided with a face 20 which confronts and is parallel with a corresponding face 20 on a tooth 19 on the other rail electrode 11,12. The tooth faces 20 on each rail electrode 11,12 are coplanar and equally spaced apart from each other by a distance which is less than the longitudinal extent of the projectile 15.

The leading flank 21 of each tooth 19 (with respect to the direction 16 of projectile 15 travel) is inclined at an angle of approximately 135° to the plane of the tooth confronting face 20. The trailing flank 22 of each tooth 19 is however inclined to the tooth confronting face 20 by an angle which is somewhat less than 90°.

The passage of the electric current through the rail electrodes 11 and 12 as it causes the propulsion of the projectile 15 is depicted by the lines 23. It will be seen from FIG. 2 that the current is prevented by the teeth 19 from concentrating in the region of the surfaces 17 and 18 which confront the projectile 15. Instead, the current follows a generally linear path along those portions of the rail electrodes 11 and 12 which are remote from the toothed regions thereof. In the regions of the teeth 19, the current is deflected from its generally linear path to flow through each tooth 19 as can be seen in the drawing. It will be noted that in order to avoid current concentrations, the transition region 24 between adjacent leading and trailing tooth flanks 21 and 22 is of curved cross-sectional configuration. It will also be noted that the edges 25 and 26 of the teeth 19 are rounded. This is to reduce the occurrence of arcing between the teeth 19 and the projectile 15 as the projectile 15 is accelerated between the rail electrodes 11 and 12.

The toothed cross-section configuration of the confronting surfaces 17 and 18 of the rail electrodes 11 and 12 thus ensure that there is not a concentration of electric current in the regions of those surfaces 17 and 18, thereby ensuring in turn that problems associated with the heating of the surfaces 17 and 18 are reduced.

I claim:

1. A rail gun comprising two elongate co-extensive spaced apart rail electrodes for carrying an electric current, said electrodes being arranged to be operationally of opposite polarity, each of said electrodes having a surface of toothed cross-section configuration along the majority of its length, each of said teeth extending transversely to the longitudinal extent of its respective rail electrodes, each tooth on one of said electrodes having a face which confronts a corresponding face on a tooth of the other rail electrode so that said confronting tooth faces are parallel, each of said confronting tooth faces being coplanar with the confronting faces of the remaining teeth on its respective rail electrodes.

2. A rail gun as claimed in claim 1 wherein said teeth on each of said rail electrodes are of similar configuration and equally spaced apart.

3. A rail gun as claimed in claim 1 wherein each of said teeth is provided with leading and trailing flanks which are inclined to said confronting tooth face.

4. A rail gun as claimed in claim 3 wherein the angle between the leading flank and confronting face of each tooth is approximately 135°.

5. A rail gun as claimed in claim 4 wherein the angle between the trailing flank and confronting face of each tooth is less than 90°.

6. A rail gun as claimed in claim 3 wherein the transitional region between said leading and trailing flanks is of curved cross-sectional configuration.

7. A rail gun as claimed in claim 1 wherein the edges of said teeth are rounded.

* * * * *